US007106153B2

(12) United States Patent
Chang et al.

(10) Patent No.: US 7,106,153 B2
(45) Date of Patent: Sep. 12, 2006

(54) WAVEGUIDE INTERCONNECTION APPARATUS

(75) Inventors: Woo Jin Chang, Daejeon-Shi (KR); Hea Cheon Kim, Daejeon-Shi (KR)

(73) Assignee: Electronics and Telecommunications Research Institute, Daejon-Shi (KR)

( * ) Notice: Subject to any disclaimer, the term of this patent is extended or adjusted under 35 U.S.C. 154(b) by 0 days.

(21) Appl. No.: 10/788,435

(22) Filed: Mar. 1, 2004

(65) Prior Publication Data

US 2004/0227597 A1 Nov. 18, 2004

(30) Foreign Application Priority Data

Dec. 5, 2003 (KR) ..... 10-2003-0088259

(51) Int. Cl.
*H01P 1/02* (2006.01)

(52) U.S. Cl. ..... 333/249; 333/254

(58) Field of Classification Search ..... 333/33–35, 333/239, 248, 249, 250, 254
See application file for complete search history.

(56) References Cited

U.S. PATENT DOCUMENTS 3,072,870 A * 1/1963 Walker ..... 333/249
3,452,306 A * 6/1969 Walker ..... 333/249
3,686,596 A * 8/1972 Albee ..... 333/249
4,982,172 A * 1/1991 Morz et al. ..... 333/248
5,381,596 A 1/1995 Ferro
5,453,154 A 9/1995 Thomas et al.
5,528,074 A * 6/1996 Goto et al. ..... 333/248
5,929,728 A 7/1999 Barnett et al.
6,274,858 B1 * 8/2001 Alton ..... 219/695
6,552,636 B1 * 4/2003 Yuanzhu ..... 333/249

OTHER PUBLICATIONS

Ito et al.; "A 60-GHz-BAND Planar Dielectric Waveguide Filter for Flip-Chip Modules"; IEEE Transactions on Microwave Theory and Techniques; Dec. 2001; pp. 2431-2436.

* cited by examiner

*Primary Examiner*—Seungsook Ham
(74) *Attorney, Agent, or Firm*—Mayer, Brown, Rowe & Maw LLP

(57) ABSTRACT

Provided is a waveguide interconnection apparatus making rectangular interconnecting portions to be a curved structure, whereby it is possible to reduce a signal reflection and a signal loss due to a mismatch occurred from a discontinuous portion where waveguides are perpendicularly connected to each other, and fabricate package products having excellent performances compared to that of the prior art in the same chip and structure.

8 Claims, 5 Drawing Sheets

WAVEGUIDE INTERCONNECTION APPARATUS

BACKGROUND

1. Field of the Invention

The present invention relates to a waveguide interconnection apparatus implementing low signal loss when interconnecting waveguides in an ultrahigh frequency circuit package and, more particularly, to a waveguide interconnection apparatus, which can reduce a signal reflection and a signal loss due to a mismatch occurred from discontinuous portions (i.e., edge) where the waveguides are perpendicularly connected to each other by making the rectangular interconnecting portion be a curved structure.

2. Discussion of Related Art

When two waveguides are interconnected in a rectangular portion in a waveguide interconnection apparatus of the prior art, discontinuity due to an occurrence of edge leads to a signal reflection and hence a signal loss. To reduce such signal loss, two waveguides have been interconnected each other to be curved, which have no discontinuous portions for the signal transmission. This is for the purpose of producing a package product with superior performance to the conventional method having the same chip and structure when the method proposed by the present invention is applied.

A waveguide interconnection apparatus in accordance with a prior art has been disclosed in the U.S. Pat. No. 5,929,728.

Hereinafter, the waveguide interconnection apparatus in accordance with the prior art will be described with reference to the accompanying drawings. FIG. 1A shows a schematic view of the waveguide interconnection apparatus in accordance with the prior art, and FIG. 1B shows a detailed view of the interconnection structure of the waveguide interconnection apparatus in accordance with the prior art.

Referring to FIG. 1A, the waveguide interconnection apparatus of the prior art consists of an upper housing 10, an intermediate housing 20, and a lower housing 30, wherein the shape of two adjacent housings is rectangle. Furthermore, an upper waveguide 10*a*, an intermediate waveguide 20*a*, and a lower waveguide 30*a* are included in the upper housing 10, the intermediate housing 20, and the lower housing 30, respectively.

To detail the ultrahigh frequency signal propagated through the cross-sectional view of the waveguide interconnection apparatus in accordance with the prior art, the ultrahigh frequency signal propagates through waveguides such that it does through the intermediate waveguide 20*a* of the intermediate housing 20 to pass the lower waveguide 30*a* of the lower housing 30 after it is inputted from the upper waveguide 10*a* of the upper housing 10 in a structure having its outer surface covered with a conductive material.

In this case, edge portions occur where the upper waveguide 10*a* of the upper housing 10 and the intermediate waveguide 20*a* of the intermediate housing 20 are contacted and where the intermediate waveguide 20*a* of the intermediate housing 20 and the lower waveguide 30*a* of the lower housing 30 are contacted during the signal propagation.

As such, these edge portions become discontinuous portions of the signal propagation, which cause a signal reflection and a signal loss due to a mismatch therefrom. In other words, when the waveguide interconnection apparatus in accordance with the prior art is employed, the above-mentioned discontinuous portions occur, which causes the waveguide structure to have the signal mismatch and a predetermined amount of signal attenuation.

Meanwhile, the upper housing 10, the intermediate housing 20, and the lower housing 30 can be produced in simple and low-cost manners such that rectangular parallelepiped waveguides are punched within a rectangular parallelepiped conductive structure, so that it is advantageous to fabricate a small-sized structure.

However, the waveguide interconnection apparatus fabricated by the above-mentioned prior art has the signal reflection and the signal loss due to a mismatch occurred from the discontinuous portions of the waveguides, which causes degradation of original performance of a semiconductor chip.

Therefore, according to the conventional method for interconnecting waveguides within a package having the waveguide structure, a mismatch occurred from discontinuous portions (i.e., edge) where the waveguides are perpendicularly connected to each other causes the signal reflection and the signal loss.

SUMMARY OF THE INVENTION

The present invention is directed to a waveguide interconnection apparatus having two waveguides interconnected to be curved to prevent discontinuous portions of the waveguide interconnection apparatus from being occurred.

This accompanies more complicated fabrication process, however, a package having original performance of a semiconductor chip can be obtained while reducing a signal reflection and a signal loss due to a mismatch occurred from the discontinuous portions.

One aspect of the present invention is to provide a waveguide interconnection apparatus, comprising: a first housing having a first waveguide therein; a second housing having a second waveguide connected to the first waveguide; and a third housing having a third waveguide connected to the second waveguide, wherein a signal propagated from the first waveguide through the second waveguide to the third waveguide is reflected to have a predetermined angle when it passes an interconnecting portion of each waveguide, and at least one of inner connecting portions and outer connecting portions between the first waveguide and the second waveguide, and between the second waveguide and the third waveguide is curved.

Here, the signal is an ultrahigh frequency signal.

In a preferred embodiment of the present invention, the second waveguide separately consists of a first portion connected to the first waveguide, a second portion connected to the first portion, and a third portion connected to the second portion and the third waveguide. Here, the first portion, the second portion and the third portion are made to be curved, linear, and curved, respectively. In addition, the first and third portions are formed to be bonded to a cover after the waveguide is curved at one surface of a rectangular parallelepiped structure made of a conductive material.

Further, the first and third housings are made in such a manner that a rectangular parallelepiped structure made of a conductive material is punched to form rectangular parallelepiped waveguides, and the second housing is made in such a manner that a rectangular parallelepiped structure made of a conductive material is punched to form a rectangular parallelepiped waveguide. Moreover, the only outer connecting portion of the inner and outer connecting portions between the first waveguide and the second waveguide is curved, and the only outer connecting portion of the inner and outer connecting portions between the second waveguide and the third waveguide is curved. And, the inner and outer connecting portions between the first waveguide and the second waveguide, and between the second waveguide and the third waveguide are curved.

Another aspect of the present invention is to provide a waveguide interconnection apparatus, comprising: a first housing having a first waveguide; and a second housing having a second waveguide connected to the first waveguide, wherein a signal propagated from the first waveguide to the second waveguide is reflected to have a predetermined angle when it passes an interconnecting portion of the waveguides, and at least one of an inner connecting portion and an outer connecting portion between the first waveguide and the second waveguide is curved.

Here, the second housing is formed to be bonded to a cover after the waveguide is curved at one surface of a rectangular parallelepiped structure made of a conductive material.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF PREFERRED EMBODIMENTS

Hereinafter, the embodiments of the present invention will be explained with reference to the accompanying drawings. However, the embodiment of the present invention can be changed into a various type, and it should be not understood that the scope of the present invention is limit to the following embodiments. The embodiments of the present invention are provided in order to explain the present invention to those skilled in the art. On the other hand, like numerals present like elements throughout the several figures and the repeated explanation of the element will be omitted.

EXAMPLE 1

Figure 1A:
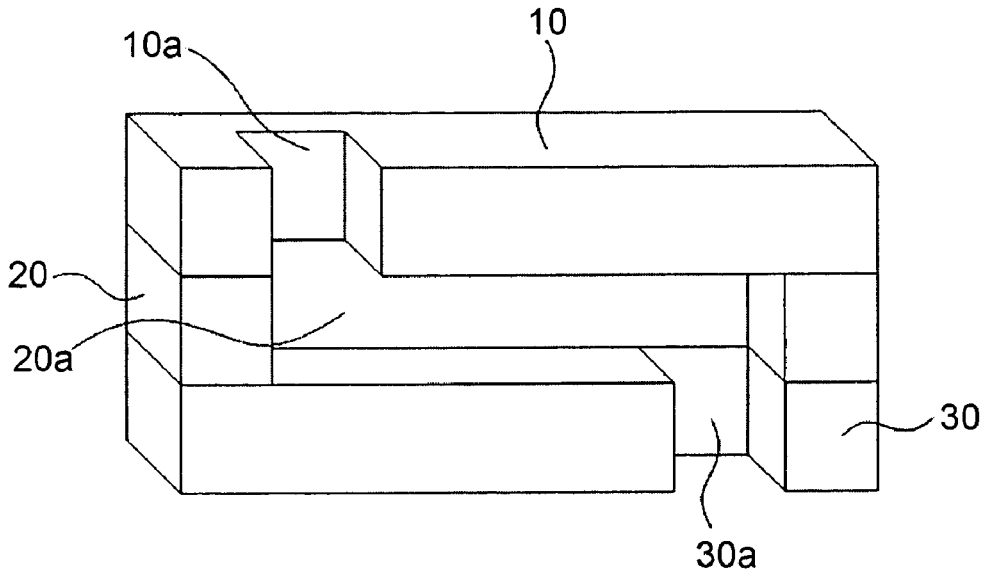
FIG. 1A (PRIOR ART)
FIG. 1A shows a schematic configuration view of a waveguide interconnection apparatus in accordance with a prior art.
Figure 1B:
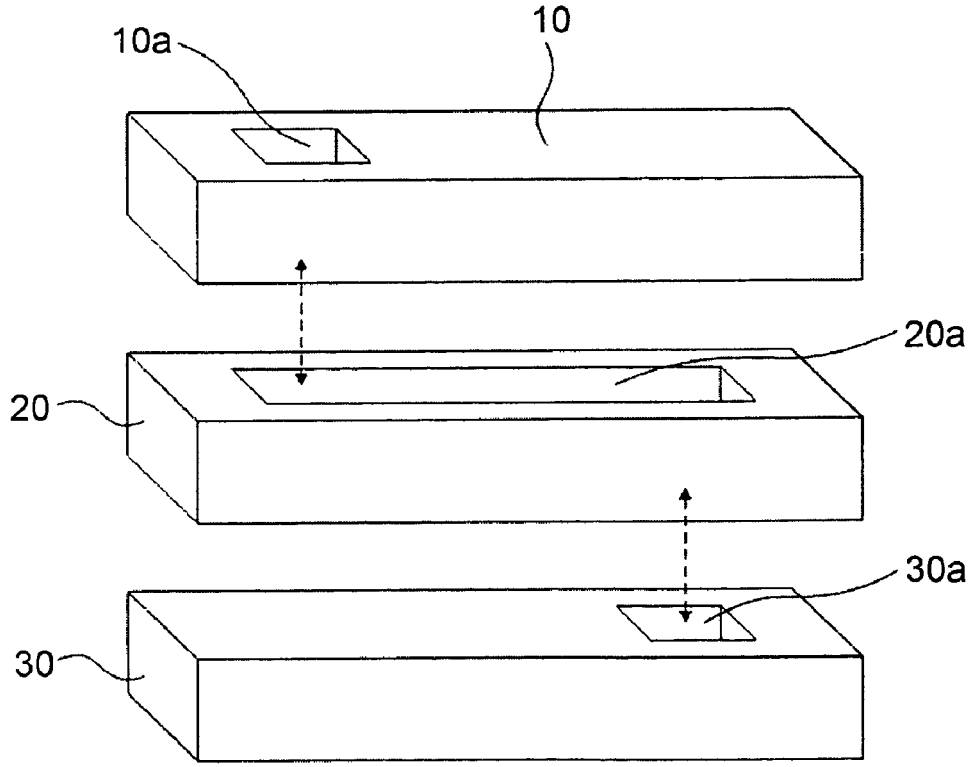
FIG. 1B (PRIOR ART)
FIG. 1B shows a detailed cross-sectional view of the interconnection structure of the waveguide interconnection apparatus in accordance with the prior art.
Figure 2:
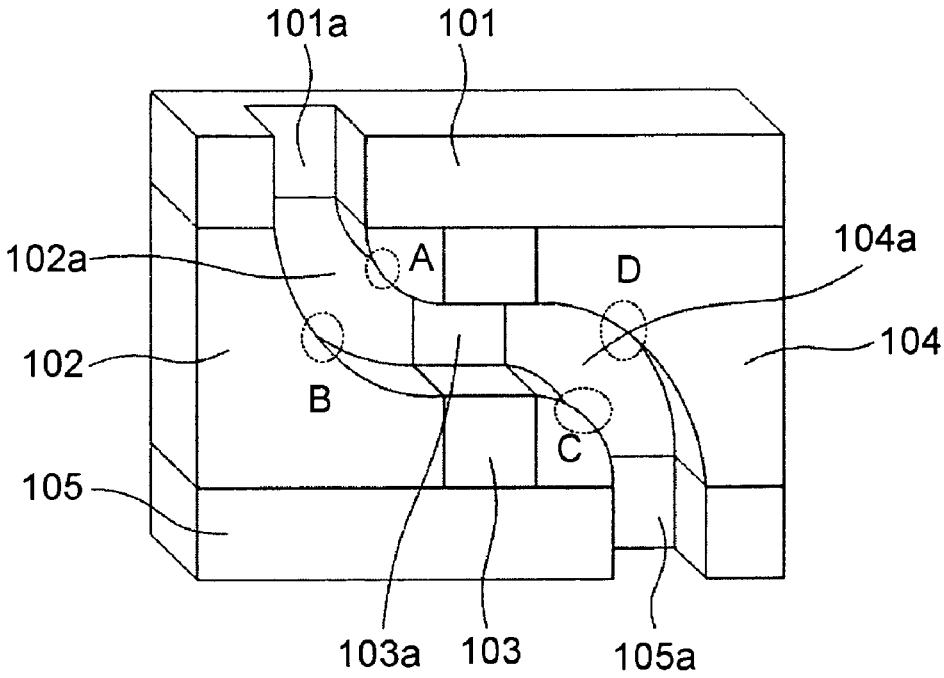
FIG. 2 shows a schematic cross-sectional view of a waveguide interconnection apparatus in accordance with a first embodiment of the present invention.
Figure 3:
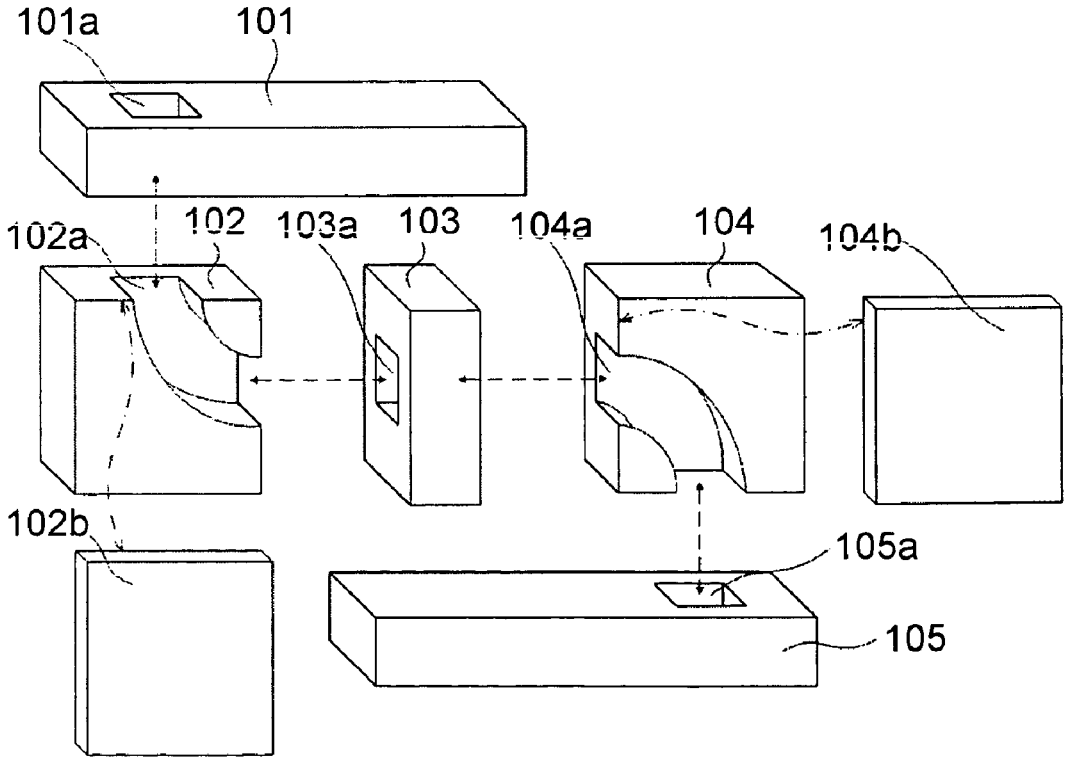
FIG. 3 shows a detailed assembly view of the waveguide interconnection apparatus of FIG. 2.
Figure 4:
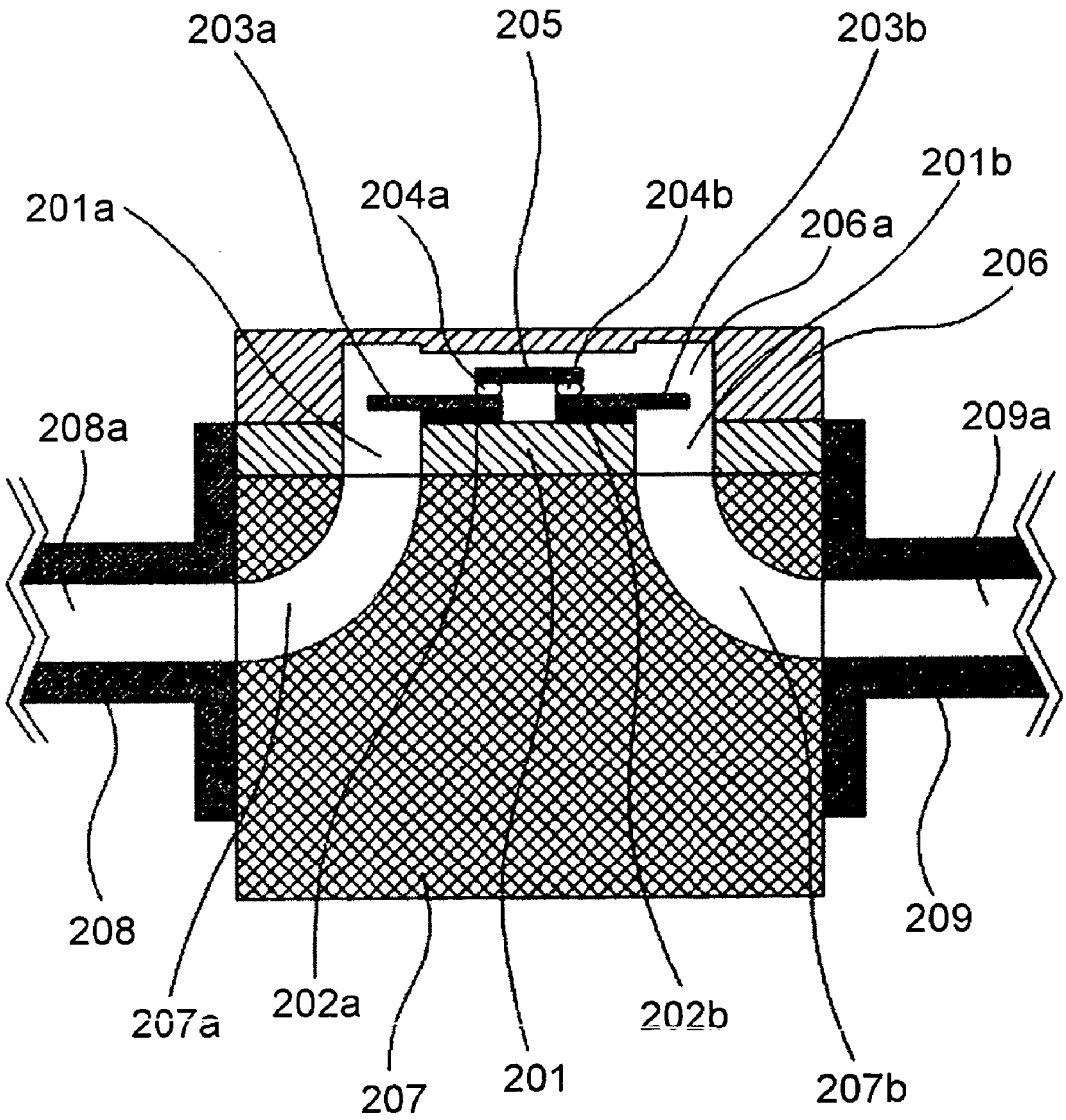
FIG. 4 shows a packaging state of the waveguide interconnection apparatus of FIG. 2.

Hereinafter, a waveguide interconnection apparatus in accordance with a first embodiment of the present invention will be described with reference to accompanying drawings. FIG. 2 shows a schematic cross-sectional view of the waveguide interconnection apparatus in accordance with a first embodiment of the present invention, FIG. 3 shows a detailed assembly view of the waveguide interconnection apparatus of FIG. 2, and FIG. 4 shows a packaging state of the waveguide interconnection apparatus of FIG. 2.

Referring to FIG. 2, the waveguide interconnection apparatus in accordance with the first embodiment of the present invention comprises a first housing 101, second housings 102, 103 and 104, and a third housing 105, and a first waveguide 101*a*, second waveguides 102*a*, 103*a* and 104*a*, and a third waveguide 105*a* are included in the first, second and third housings 101, 102, 103, and 104, and 105, respectively. The signal propagated from the first waveguide 101*a* through the second waveguides 102*a*, 103*a*, and 104*a* to the third waveguide 105*a*, is reflected to have a predetermined angle when it passes each interconnecting portion of the waveguides.

In addition, at least one of an inner connecting portion A and an outer connecting portion B between the first waveguide 101*a* and the second waveguides 102*a*, 103*a*, and 104*a*, and an inner connecting portion C and an outer connecting portion D between the second waveguides 102*a*, 103*a*, and 104*a* and the third waveguide 105*a*, is made to be curved. For convenience of illustration, FIG. 2 shows that all of the inner connecting portions A, C and the outer connecting portions B, D are curved.

As shown in FIG. 2, the inner connecting portions represent curves corresponding to relatively small circles, and the outer connecting portions represent curves corresponding to relatively big circles on the side of the propagating signal.

In this case, to remove the discontinuous portions (i.e., edge) while the signal propagates, the second housing is divided into three portions to have their rectangular edges to be curved. In other words, the waveguide 102*a* of a first portion 102 and the waveguide 104*a* of a third portion 104 in the second housing are curved, which result in removal of the discontinuous portions and minimization of the signal reflection and the signal loss.

As such, to see the signal propagation within the waveguide interconnection apparatus, an ultrahigh frequency signal, for example, propagates through waveguides in a structure with its outer surface covered with a conductive material, so that it propagates through the second waveguides 102*a*, 103*a*, 104*a* of the second housings 102, 103, and 104 to the third waveguide 105*a* of the third housing 105 after it is inputted to the first waveguide 101*a* of the first housing 101.

FIG. 3 shows a detailed assembly view of the waveguide interconnection apparatus according to a first embodiment of the present invention. The present waveguide interconnection apparatus comprises the first housing 101, the first portion 102 of the second housing, a first portion cover 102*b*, the second portion 103 of the second housing, the third portion 104 of the second housing, and a third portion cover 104*b*.

Referring to FIG. 3, a rectangular parallelepiped structure made of a conductive material is punched to have the first housing 101, the second portion 103 of the second housing and the third housing 105, which form rectangular parallelepiped waveguides, and the first portion 102 and the third portion 104 of the second housing are made to have the waveguides 102*a* and 104*a* curved and the covers 102*b* and 104*b* are adhered thereto.

FIG. 4 shows a packaging state of the waveguide interconnection apparatus according to a first embodiment of the present invention.

Referring to FIG. 4, adhesives 202*a* and 202*b* are applied on a second housing 201 and PCBs 203*a* and 203*b* for microstrip-waveguide transition are then mounted thereon, which are subjected to a predetermined temperature and a predetermined time to be adhered to the second housing 201. Bonding solid materials 204*a* and 204*b* are then applied on the PCBs 203*a* and 203*b* to flip-chip bond a semiconductor chip 205.

The semiconductor chip 250 is turned over to have its upper surface face the lower direction and then is flip-chip bonded with the PCBs 203*a* and 203*b*. The second housing 201 and a first housing 206 are then bonded together and a third housing 207 is also bonded thereto, and housing covers are covered, so that the package is completed. Meanwhile, waveguide structures 208 and 209 are also connected for connecting with an external structure.

To see the ultrahigh frequency signal propagation with reference to FIG. 4, the signal inputted to a waveguide 208*a* of the waveguide structure 208 passes through the waveguide 207*a* of the third housing 207 and the waveguide 201*a* of the second housing 201 to the PCB 203*a* for microstrip transition, so that the signal of the waveguide is changed into a signal of a microstrip-line type, and the changed signal passes through the microstrip line of the PCB and the bonding solid material 204*a* to the semiconductor chip 205.

The signal having the performance of the semiconductor chip 205 passes through the bonding solid material 204*b*, the PCB 203*b* for microstrip waveguide transition, and the microstrip line of the PCB 203*b*, so that the signal of the microstrip line is changed to the waveguide signal, and this waveguide signal passes through the waveguide 206*a* of the first housing 206 and a waveguide 201*b* of the second housing 201 so that it is outputted to a waveguide 209*a* of the waveguide structure 209.

As such, the package of the present invention is rounded off not to have the discontinuous portion at the interconnecting portion of the waveguides. As a result, the signal reflection and the signal loss are very less compared to the conventional method, and the original performance of the semiconductor chip could be maintained continuously.

EXAMPLE 2

Figure 5:
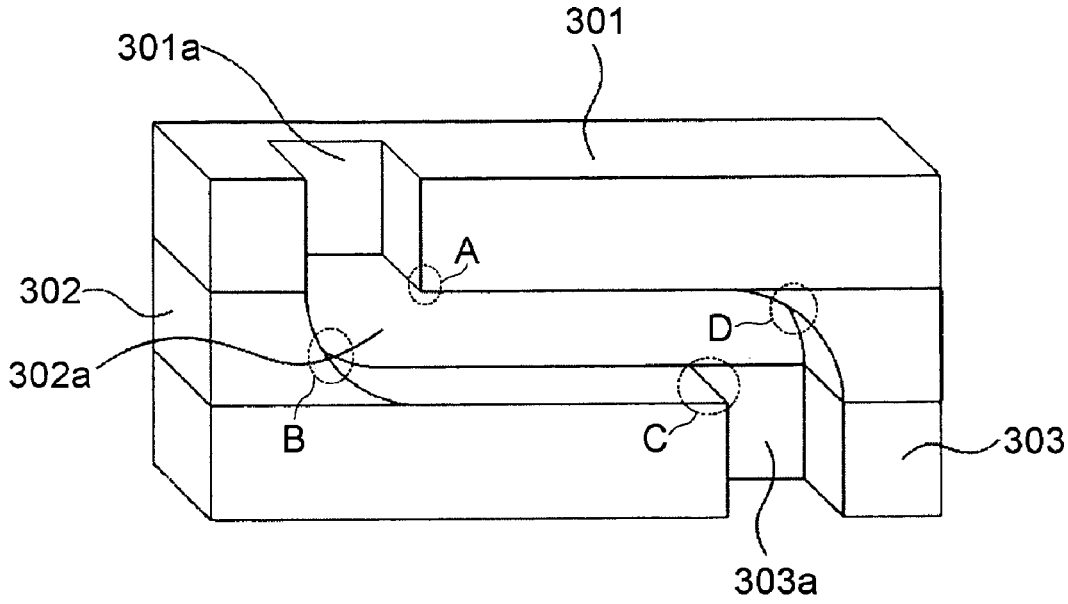
FIG. 5 shows a schematic cross-sectional view of a waveguide interconnection apparatus in accordance with a second embodiment of the present invention.
Figure 6:
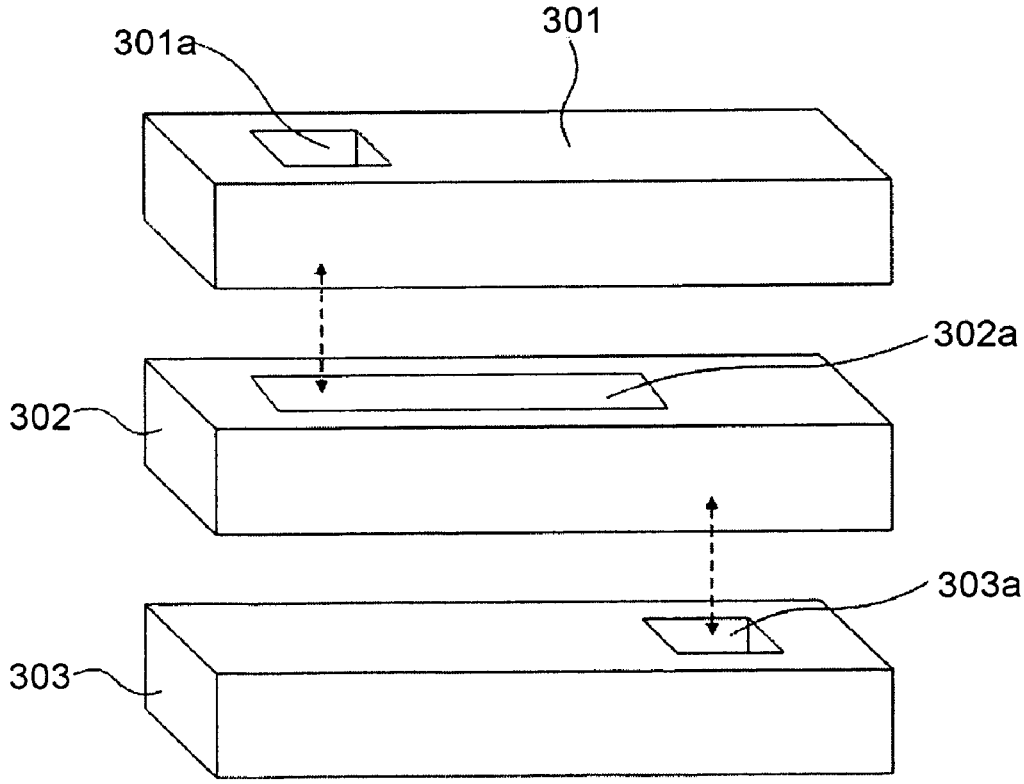
FIG. 6 shows a detailed assembly view of the waveguide interconnection apparatus of FIG. 5.
Figure 7:
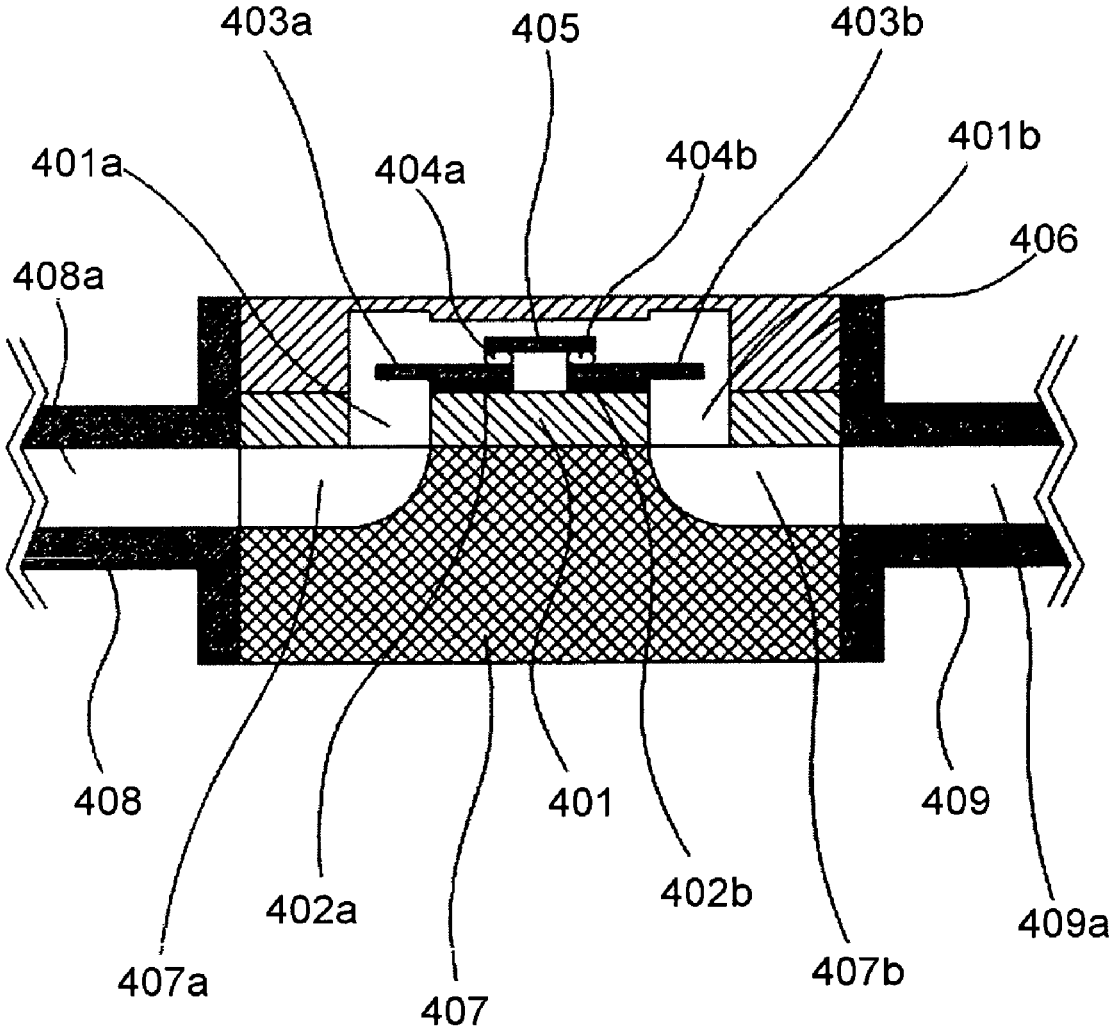
FIG. 7 shows a packaging state of the waveguide interconnection apparatus of FIG. 5.

FIG. 5 shows a schematic cross-sectional view of a waveguide interconnection apparatus in accordance with a second embodiment of the present invention, FIG. 6 shows a detailed assembly view of the waveguide interconnection apparatus of FIG. 5, and FIG. 7 shows a packaging state of the waveguide interconnection apparatus of FIG. 5.

The waveguide interconnection apparatus in accordance with the second embodiment of the present invention is characterized in that it has a more simplified structure than that of FIG. 2, whereby the size of the package can be reduced and the fabrication process would be simplified.

Referring to FIG. 5, the waveguide interconnection apparatus in accordance with the second embodiment of the present invention comprises a first housing 301, a second housing 302, and a third housing 303, wherein the shape of the two adjacent housings is curved instead of rectangle. A first waveguide 301*a*, a second waveguide 302*a*, and a third waveguide 303*a* are included in the first housing 301, the second housing 302, and the third housing 303, respectively.

To see the signal propagation in the present waveguide interconnection apparatus with reference to FIG. 5, when the ultrahigh frequency signal is inputted to the waveguide 301*a* of the first housing 301, the signal passes through the second waveguide 302*a* of the second housing 302 and the third waveguide 303*a* of the third housing 303. In this case, while the signal propagates, a discontinuous portion occurs in an inner interconnecting portion A where the right portion of the waveguide 301*a* of the first housing 301 and the waveguide 302*a* of the second housing 302 are contacted each other, however, the discontinuous portion does not occur in an outer interconnecting portion B where the left portion of the waveguide 301*a* of the first housing 301 and the waveguide 302*a* of the second housing 302 are contacted each other.

In addition, the discontinuous portion occurs in an inner interconnecting portion C where the left portion of the waveguide 303*a* of the third housing 303 and the waveguide 302*a* of the second housing 302 are contacted each other, however, the discontinuous portion does not occur in an outer interconnecting portion D where the right portion of the third waveguide 303*a* of the third housing 303 and the waveguide 302*a* of the second housing 302 are contacted each other.

In accordance with the second embodiment, it is advantageous that the discontinuous portions are rounded off, which brings in no occurrence of signal attenuation due to a mismatch, a simplified fabrication method, a small-sized package, and a low cost.

FIG. 6 shows a detailed assembly view of the waveguide interconnection apparatus in accordance with the second embodiment of the present invention. The present waveguide interconnection apparatus comprises the first housing 301, the second housing 302 and the third housing 303. In this structure, the first, second and third housings 301, 302 and 303 are interconnected, so that two perpendicular portions are formed. A rectangular parallelepiped structure made of a conductive material can be punched to have the rectangular parallelepiped housings 301, 302, and 303, so that it is advantageous to fabricate the low-cost and small-sized structure.

FIG. 7 shows a packaging state of the waveguide interconnection apparatus of FIG. 5. The package is fabricated such that adhesives 402*a* and 402*b* are applied to bond PCBs 403*a* and 403*b* on a second housing 401, and the PCBs 403*a* and 403*b* for microstrip-waveguide transition are mounted thereon and subjected to a predetermined temperature and a predetermined time to bond with the second housing 401, and bonding solid materials 404*a* and 404*b* are then adhered to flip-chip bond a semiconductor chip 405 on the PCBs 403*a* and 403*b*.

The semiconductor chip 405 is then turned over to have its upper surface face the lower direction to be flip-chip bonded with the PCBs 403*a* and 403*b*. The second housing 401 and a first housing 406 are bonded each other and a third housing 407 is also bonded thereto to complete the package. Waveguide structures 408 and 409 are then connected to connect with an external structure.

To see the ultrahigh frequency signal propagation with reference to FIG. 7, the signal inputted to the waveguide 408*a* of the waveguide structure 408 passes through a waveguide 407*a* of the third housing and a waveguide 401*a* to the PCB 403*a* for microstrip transition, so that the signal of the waveguide is changed into a signal of a microstrip line type, and the changed signal passes through the microstrip line of the PCB and the bonding solid material 404*a* to the semiconductor chip 405.

The signal having the performance of the semiconductor chip 405 passes through the bonding solid material 404*b*, the PCB 403*b* for microstrip waveguide transition, and the microstrip line, so that the signal of the microstrip line is changed to the waveguide signal, and this waveguide signal passes through a waveguide 401*b* and a waveguide 407*b* of the third housing so that it is outputted to a waveguide 409*a* of the waveguide structure 409.

When the package is fabricated by the above-mentioned method, the fabrication process thereof can be simplified and the package can be small-sized, and a signal loss due to the package can be improved compared to the fabrication method of the prior art.

Meanwhile, the waveguide interconnection apparatus in accordance with the second embodiment of the present invention has reduced the number of the discontinuous portions compared to the prior art, however, has more discontinuous portions than the first embodiment. Thus, performance varies from the lowest level to the highest one, which corresponds to the prior art, the second embodiment, and the first embodiment in this order, and the fabrication complexity and the product cost also vary from the lowest level to the highest one, which corresponds to the prior art, the first embodiment, and the second embodiment in this order.

On the other hand, the waveguide interconnection apparatus in accordance with the modified embodiment of the present invention comprises a first housing having a first waveguide, and a second housing having a second waveguide connected to the first waveguide, wherein the signal propagated from the first waveguide to the second waveguide is reflected to have a predetermined angle when it passes through interconnecting portions of the waveguides, and at least one of the inner connecting portion and the outer connecting portion between the first waveguide and the second waveguide can be curved. In this case, the second housing can be bonded with a cover for covering one side of a rectangular parallelepiped structure made of conductive material after a curved waveguide is made on the side of the rectangular parallelepiped structure.

As mentioned above, the present invention has made the shape of two adjacent waveguides to be curved to prevent discontinuous portions of signal propagation from being occurred, which leads to solve the signal reflection and signal loss problems due to a mismatch occurred from the discontinuous portions (i.e., edge) where two adjacent waveguides are perpendicularly connected to each other.

This fabrication method decreases the signal reflection and the signal loss due to the mismatch occurred from the discontinuous portions, so that the package having the original performance of the semiconductor chip can be fabricated.

While the present invention has been described with reference to a particular embodiment, it is understood that the disclosure has been made for purpose of illustrating the invention by way of examples and is not limited to limit the scope of the invention. And one skilled in the art can make amend and change the present invention without departing from the scope and spirit of the invention.

What is claimed is:

1. A waveguide interconnection apparatus, comprising:

a first housing having a first waveguide therein;

a second housing having a second waveguide connected to the first waveguide; and a third housing having a third waveguide connected to the second waveguide, wherein a signal propagated from the first waveguide through the second waveguide to the third waveguide is reflected to have a predetermined angle when it passes an interconnecting portion of each waveguide, and both inner connecting portions and outer connecting portions between the first waveguide and the second waveguide, and between the second waveguide and the third waveguide is curved wherein the second waveguide separately consists of a first portion connected to the first waveguide, a second portion connected to the first portion, and a third portion connected to the second portion and the third waveguide; and wherein the first portion, the second portion and the third portion are made to be curved, linear, and curved, respectively.

2. The waveguide interconnection apparatus as claimed in claim 1, wherein the signal is an ultrahigh frequency signal.

3. The waveguide interconnection apparatus as claimed in claim 1, wherein the first and third housings are made in such a manner that a rectangular parallelepiped structure made of a conductive material is punched to form rectangular parallelepiped waveguides.

4. The waveguide interconnection apparatus as claimed in claim 1, wherein the second housing is made in such a manner that a rectangular parallelepiped structure made of a conductive material is punched to form a rectangular parallelepiped waveguide.

5. A waveguide interconnection apparatus, comprising:

a first housing having a first waveguide therein;

a second housing having a second waveguide connected to the first waveguide; and a third housing having a third waveguide connected to the second waveguide, wherein a signal propagated from the first waveguide through the second waveguide to the third waveguide is reflected to have a predetermined angle when it passes an interconnecting portion of each waveguide, and both inner connecting portions and outer connecting portions between the first waveguide and the second waveguide, and between the second waveguide and the third waveguide is curved wherein the second waveguide separately consists of a first portion connected to the first waveguide, a second portion connected to the first portion, and a third portion connected to the second portion and the third waveguide; and wherein the first and third portions are bonded to a cover after to form a rectangular parallelepiped structure.

6. The waveguide interconnection apparatus as claimed in claim 5, wherein the first and third housings are made in such a manner that a rectangular parallelepiped structure made of a conductive material is punched to form rectangular parallelepiped waveguides.

7. The waveguide interconnection apparatus as claimed in claim 5, wherein the second housing is made in such a manner that a rectangular parallelepiped structure made of a conductive material is punched to form a rectangular parallelepiped waveguide.

8. The waveguide interconnection apparatus as claimed in claim 5, wherein the signal is an ultrahigh frequency signal.

* * * * *